US005357874A

United States Patent [19]

Palmer

[11] Patent Number: 5,357,874

[45] Date of Patent: Oct. 25, 1994

[54] CHANNEL ASSEMBLY WITH SNAP-IN INSERT

[75] Inventor: Dale M. Palmer, Florence, Ala.

[73] Assignee: ABCO Office Furniture Inc., Florence, Ala.

[21] Appl. No.: 921,647

[22] Filed: Jul. 30, 1992

[51] Int. Cl.[5] ..... A47B 35/00

[52] U.S. Cl. ..... 108/50; 312/223.3; 312/223.6

[58] Field of Search ..... 108/28, 50, 130, 161, 108/25, 26, 41, 155, 157; 312/194, 223.2, 204, 293.1, 293.3, 223.1, 223.3, 223.4, 223.5, 223.6

[56] References Cited

U.S. PATENT DOCUMENTS

| | | | |
|---|---|---|---|
| 1,786,823 | 12/1930 | Carrington et al. | 312/194 |
| 1,905,402 | 4/1933 | Sink | 312/194 |
| 3,000,682 | 9/1961 | Loew et al. | 312/194 |
| 3,635,174 | 1/1972 | Ball et al. . | |
| 4,066,305 | 1/1978 | Gazarek . | |
| 4,094,256 | 6/1978 | Holper et al. . | |
| 4,296,981 | 10/1981 | Hildebrandt et al. . | |
| 4,535,703 | 8/1985 | Henriott et al. . | |
| 4,654,756 | 3/1987 | Wilson et al. . | |
| 4,681,378 | 7/1987 | Hellman, III . | |
| 4,712,842 | 12/1987 | Price et al. . | |
| 4,948,205 | 8/1990 | Kelley . | |
| 5,016,947 | 5/1991 | Hsu et al. . | |

*Primary Examiner*—Clifford D. Crowder
*Assistant Examiner*—Larry D. Worrell, Jr.
*Attorney, Agent, or Firm*—Nies, Kurz, Bergert & Tamburro

[57] ABSTRACT

A channel or housing for electrical cord and wire management in a table leg assembly is disclosed. The channel or housing includes a stationary insert member and a snap-in insert member, both of which are installed interiorly of a pair of legs of a computer table or the like. The stationary insert member is initially installed between the table legs by means of hex head screws or the like, having spacer members installed thereon for receiving spacer slots on the snap-in insert member. The snap-in insert member is of shorter overall length than the stationary insert member, and the spacer members are so positioned that an opening is created at both the upper and lower ends of the snap-in insert. Thus electrical wiring or cords may be retained within the table leg assembly between the snap-in insert and the stationary insert and easily passed through the channel between the two inserts.

6 Claims, 3 Drawing Sheets

CHANNEL ASSEMBLY WITH SNAP-IN INSERT

BACKGROUND AND SUMMARY OF THE INVENTION

This invention relates to office furniture, and more particularly to an insert for the leg assembly of a computer table or the like which provides for channeling and management of the electrical wires and cords used in connection with the computer furniture.

There are numerous wires, cables, and electrical cords associated with office spaces, and particularly with the modern modular offices that are designed to compactly arrange various desk articles such as telephones, dictating machines, calculators computers, printers, and typewriters. A major problem associated with such an arrangement is the unsightly view and annoying presence of these wires and cords as they frequently become entangled beneath the work surface. Such a situation is both physically annoying and aesthetically unpleasing to working personnel and may contribute to decreased productivity. In addition, there is a need for apparatus which will provide a safe and orderly arrangement of such wires and cords and which will allow the proper wire or cord to be selected when the need arises.

Previous wire concealing and managing furniture constructions are described in the following U.S. Pat. Nos. 3,635,174 to Ball et al; 4,066,305 to Gazarek; 4,094,256 to Holper et al; 4,296,981 to Hildebrandt et al; 4,535,703 to Henriott et al; 4,654,756 to Wilson et al; 4,681,378 to Hellman, III; 4,712,842 to Price et al; 4,948,205 to Kelley; and 5,016,947 to Hsu et al.

A principal object of the present invention is to provide a channel or housing which includes a snap-in insert and a stationary insert for the leg or base of a computer table or the like and which can function to secure electrical cords and wires on the interior of the leg so as to maintain a clean and obstacle-free environment under the work surface.

It is another object of the present invention to provide an easily removable snap-in insert for the leg assembly of a computer table or the like such that electrical cords may be easily retained within or released from a position inside the leg of the table.

Further objects, features, and advantages of the present invention will become more readily apparent from the following description taken in conjunction with the accompanying drawings.

DESCRIPTION OF THE PREFERRED EMBODIMENTS

Figure 1:
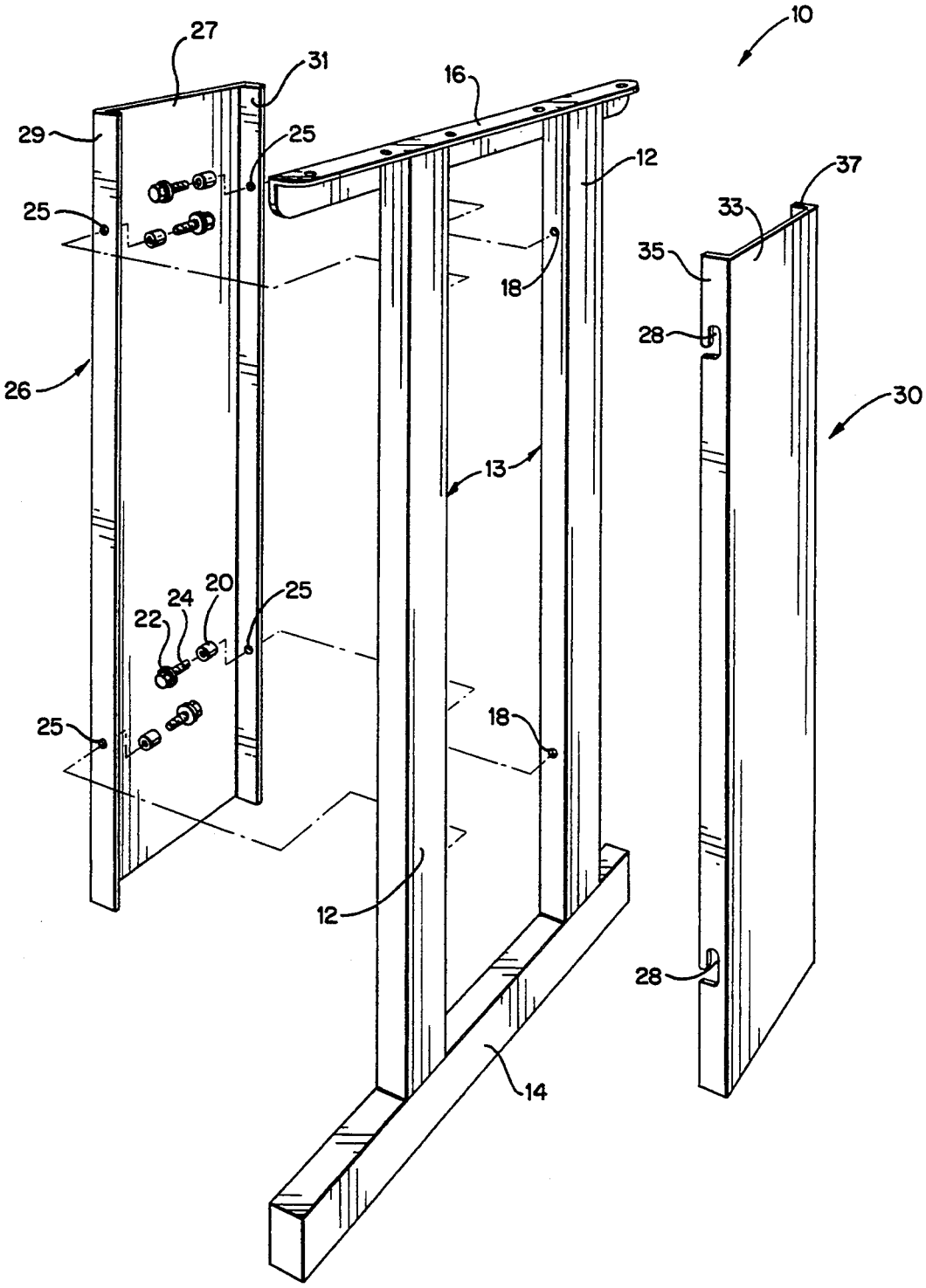
FIG. 1 is an exploded perspective view of a typical computer table leg assembly having a pair of spaced apart vertical leg members and showing the snap-in insert and the stationary insert of the present invention prior to installation on the table leg.
Figure 2:
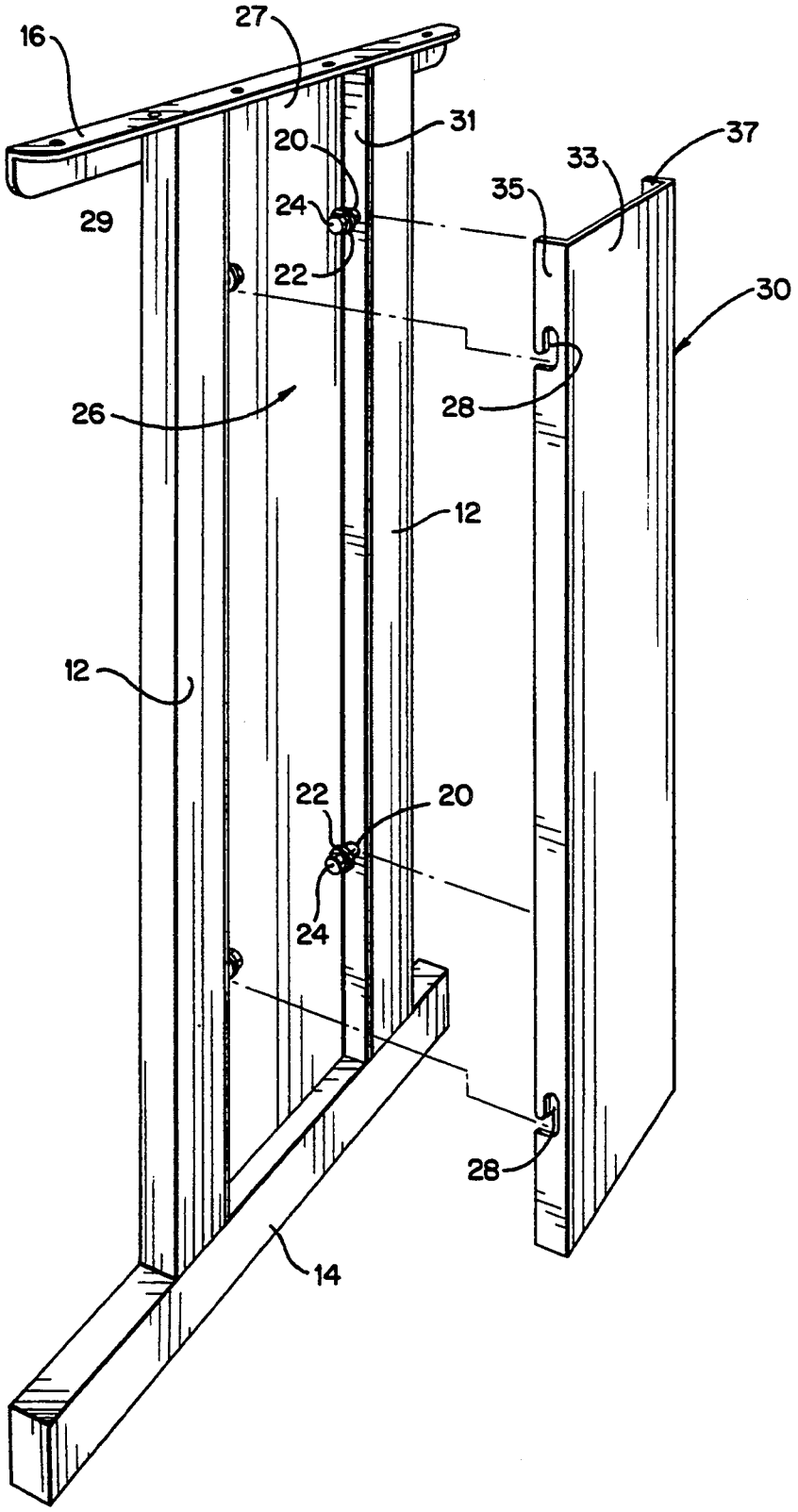
FIG. 2 is a perspective view similar to FIG. 1 but with the stationary insert of the present invention installed on the leg assembly.
Figure 3:
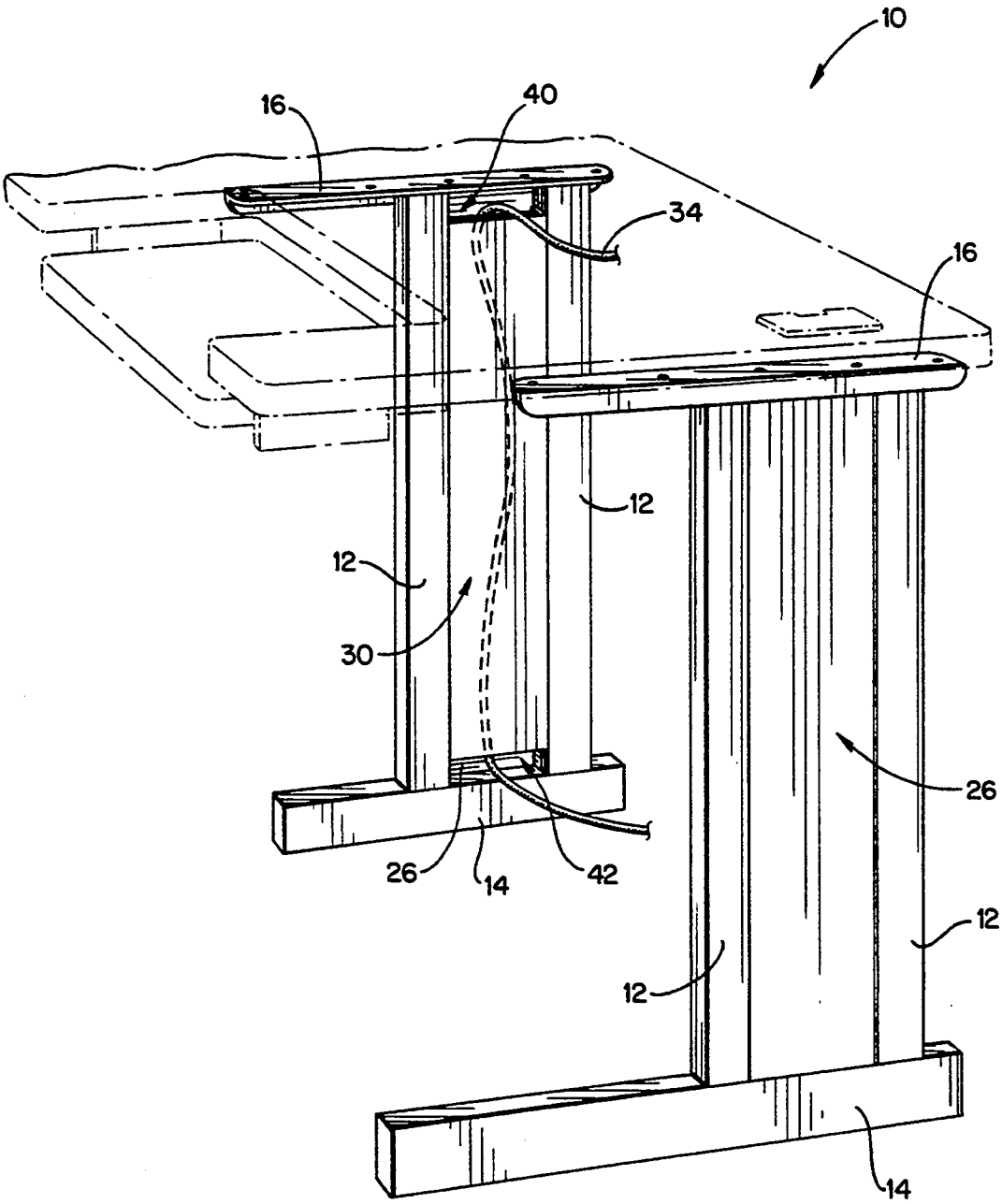
FIG. 3 is a perspective view similar to FIG. 1 but with both the stationary insert and the snap-in insert of the present invention installed on the leg assembly.

In the embodiment of the invention as shown in FIGS. 1 through 3, there is provided a computer table leg assembly, shown generally as 10, with two vertical leg members 12, a leg base 14, and a table support member 16. The insert members which, together with the lea members 12, form the channel or housing for cords or wiring, include a stationary insert 26 and a snap-in insert 30. The stationary insert 26 has a generally U-shaped configuration in cross-section, with an end wall 27 and side walls 29 and 31. The snap-insert 30 also has a generally U-shaped configuration, with end wall 33 and side walls 35 and 37.

The interior surface 13 of each leg member 12 is provided with two holes 18 for receiving fasteners such as hex head screws 24. Each hex head screw 24 is inserted through a washer 22, a spacer 20, and a hole 25 in one of the side walls 29, 31 of the stationary insert 26 of the present invention before being threadedly inserted into a respective hole 18 of a leg member 12. The holes 25 in the stationary insert 26 are aligned with the holes 18 in the leg members 12 so as to allow simple connection using the hex head screws 24. In an alternative embodiment, a one-piece combination hex head screw and washer may be employed.

The snap-in insert 30 is then attached to the table assembly 10 by means of spacer slots 28 on the side walls 35 and 37 of the snap-in insert 30. The spacer slots 28 align with the spacers 20 on the head screws 24 so as to create a snug fit.

As shown in FIG. 3, the snap-in insert 30 is of shorter length than the stationary insert 26. The spacer slots 28 are so positioned on the snap-in insert 30 as to create an opening 40, 42 at both the upper and lower ends of the insert 30. Thus electrical wiring or cords 34 may be retained in the table leg assembly 10 between the snap-in insert 30 and the stationary insert 26 and easily passed through the channel between inserts 26 and 30.

By the present invention, there is provided a double post leg assembly having easily removable inserts on the inside of each leg which allow safe and efficient channeling of electrical cords from the work surface through the leg assembly to the power source.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A channel assembly with snap-in insert for use in retaining electrical wiring in a table leg assembly having a pair of spaced vertical leg members with each leg member having an interior side wall which faces the other leg member, comprising:

a stationary insert member of a generally U-shaped cross-section formed by a first end wall and a first pair of side walls, said stationary insert member being of a size such that each side wall thereof will fit adjacent a respective interior side wall of the pair of spaced vertical leg members;

a snap-in insert member of a generally U-shaped cross-section formed by a second end wall and a second pair of side walls, said snap-in insert member being of a size such that each side wall thereof will fit adjacent a respective side wall of the stationary insert member; and means mounted on said leg members for releasably securing said snap-in insert member to said stationary insert member;

wherein the snap-in insert member is of shorter length than the stationary insert member and with said snap-in insert member being positioned relative to said stationary insert member so that an opening is provided adjacent both the upper and lower ends of the snap-in insert member.

2. A leg assembly for a computer table which provides for channeling and management of electrical wires and cords, comprising:

a table leg assembly having a pair of spaced vertical leg members with each leg member having an interior side wall which faces the other leg member;

a stationary insert member of a generally U-shaped cross-section formed by a first end wall and a first pair of side walls, said stationary insert member being of a size such that each side wall thereof will fit adjacent a respective interior side wall of the pair of spaced vertical leg members;

a snap-in insert member of a generally U-shaped cross-section formed by a second end wall and a second pair of side walls, said snap-in insert member being of a size such that each side wall thereof will fit adjacent a respective side wall of the stationary insert member;

means for securing the stationary insert member to the leg members of the table leg assembly; and means for releasably securing said snap-in insert member to said stationary insert member;

wherein the snap-in insert member is of shorter length than the stationary insert member and with said snap-in insert member being positioned relative to said stationary insert member so that an opening is provided adjacent both the upper and lower ends of the snap-in insert member.

3. The channel assembly of claim 1 wherein said releasably securing means includes screw means with a spacer mounted thereon for receiving a spacer slot in the snap-in insert member.

4. The channel assembly of claim 3 wherein said spacer slot is located in a side wall of the snap-in insert member.

5. The leg assembly of claim 2 wherein said releasably securing means includes screw means with a spacer mounted thereon for receiving a spacer slot in the snap-in insert member.

6. The leg assembly of claim 5 wherein said spacer slot is located in a side wall of the snap-in insert member.

* * * * *